US010661470B2

(12) United States Patent
Bauer et al.

(10) Patent No.: US 10,661,470 B2
(45) Date of Patent: May 26, 2020

(54) DRIVING TOOL FOR DRIVING FASTENING MEANS INTO WORKPIECES

(71) Applicant: Joh. Friedrich Behrens AG, Ahrensburg (DE)

(72) Inventors: Joachim Bauer, Bad Oldesloe (DE); Konrad Kahler, Großhansdorf (DE)

(73) Assignee: Joh. Friedrich Behrens AG, Ahrensburg (DE)

( * ) Notice: Subject to any disclaimer, the term of this patent is extended or adjusted under 35 U.S.C. 154(b) by 210 days.

(21) Appl. No.: 15/982,149

(22) Filed: May 17, 2018

(65) Prior Publication Data

US 2018/0333888 A1 Nov. 22, 2018

(30) Foreign Application Priority Data

May 19, 2017 (EP) ..... 17171988.3

(51) Int. Cl.
*B27F 7/09* (2006.01)
*B25C 1/04* (2006.01)
(Continued)

(52) U.S. Cl.
CPC ..... *B27F 7/09* (2013.01); *B25C 1/04* (2013.01); *B27F 7/13* (2013.01); *B25C 1/041* (2013.01); *B27F 7/003* (2013.01)

(58) Field of Classification Search
CPC ..... B25C 1/04; B25C 1/046; B25C 1/047; B25C 1/08; B27F 7/09; B27F 7/003;
(Continued)

(56) References Cited

U.S. PATENT DOCUMENTS 3,524,577 A 8/1970 Smith
3,601,303 A * 8/1971 Leach ..... B27F 7/34 227/124

(Continued)

FOREIGN PATENT DOCUMENTS

DE 3033467 A1 4/1982
DE 202009017659 U1 6/2011
WO 03/092953 A1 11/2003

*Primary Examiner* — Scott A Smith
(74) *Attorney, Agent, or Firm* — Vidas Arrett & Steinkraus P.A.

(57) ABSTRACT

A driving tool for driving fasteners means into workpieces comprising a main cylinder with a piston displaceable therein and a sealing element on the lower end with a first through hole through which a piston rod connected to the piston is guided in a sealing manner, a pressing cylinder that carries on the lower end an outlet tool with a driving channel into which a lower section of a driving tappet connected to the piston rod projects through an upper opening and that has a lower opening at the bottom for discharging fasteners, a magazine for fastening means that is attached to a side opening of the driving channel in order to supply fasteners to the driving channel, a first holding device that has a first holding element connected to the piston rod and a second holding element connected to the pressing cylinder that are designed so that the pressing cylinder can be displaced into an upper pressing cylinder position by displacing the piston into an upper piston position and the outlet tool can be placed onto a workpiece by displacing the piston downwards from the upper piston position, a first stop device that has a first stop element connected to the piston rod and a second stop element connected to the pressing cylinder that are designed to limit the downward
(Continued)

displacement of the driving tappet in order to drive a fastening element out of the driving channel and into a workpiece to a determined penetration depth by the driving tappet.

15 Claims, 17 Drawing Sheets

(51) Int. Cl.
*B27F 7/13* (2006.01)
*B27F 7/00* (2006.01)

(58) Field of Classification Search
CPC ..... B27F 7/006; B27F 7/02; B27M 3/0073; B21J 15/105; B21J 15/32
USPC ... 227/2, 7, 8, 130, 140, 142, 120, 113, 153, 227/51, 110; 29/243.53, 430, 432, 281.4, 29/816
See application file for complete search history.

(56) References Cited

U.S. PATENT DOCUMENTS 3,616,673 A * 11/1971 Miklos ..... B21J 15/048 29/798
3,847,321 A * 11/1974 Charlez ..... B27F 7/02 227/7
4,131,009 A * 12/1978 Hara ..... B21J 15/105 227/120
4,310,056 A * 1/1982 Olsson ..... B21J 15/105 173/169
4,782,989 A * 11/1988 Wallin ..... B27F 7/02 227/110
4,893,394 A * 1/1990 Muller ..... B23P 19/062 227/59
5,312,022 A * 5/1994 Thompson ..... B27F 7/006 227/130
5,469,610 A * 11/1995 Courian ..... B21J 15/025 227/55
5,651,169 A * 7/1997 Ohuchi ..... B21J 15/105 227/130
5,873,510 A * 2/1999 Hirai ..... B25C 1/042 227/130
5,974,660 A * 11/1999 Muller ..... B21J 15/32 221/224
6,148,507 A * 11/2000 Swanson ..... B21J 15/105 29/243.53
6,263,561 B1 * 7/2001 Sickels ..... B21J 15/32 29/798
6,431,428 B1 * 8/2002 Chen ..... B25C 1/00 227/119
6,499,206 B1 * 12/2002 Eure ..... B27M 3/0073 227/110
6,519,997 B2 * 2/2003 Luhm ..... B21J 15/105 206/347
6,533,156 B1 * 3/2003 Chang ..... B25C 1/041 227/130
7,228,997 B1 6/2007 Thompson
8,925,173 B2 * 1/2015 Smith ..... B27F 7/006 227/109

* cited by examiner

DRIVING TOOL FOR DRIVING FASTENING MEANS INTO WORKPIECES

The invention relates to a driving tool for driving fastening means into workpieces.

Driving tools of the type according to the invention are used to drive fastening means into workpieces to a determined penetration depth. This is necessary, for example, when fastening plasterboard or gypsum fiber board to wooden components for houses. The nail heads may not penetrate too deeply into the outer layer of board and destroy it. The driving in of nails to a given driving depth can also be desired due to aesthetic reasons, for example when facing the outside of wood parts with wooden boards.

Driving tools are used for this which slowly drive the nails into the workpiece. The driving takes place by means of compressed air. To absorb the high driving forces, the driving tools are arranged on holding devices. Affixing driving tools to electromotively driven bridges that are movable over a workbench along tracks is known. Such woodworking bridges can carry further woodworking tools such as drills, saws or mills. Automatically working woodworking bridges are also known.

DE 20 2009 017 659 U1, the entire contents of which are hereby incorporated by reference, describes a driving module for driving in particular magazinized fastening means, in particular magazinized nails, into workpieces. The driving module has an aggregate support for a driving aggregate, wherein the driving aggregate has a driver drive that acts on the respective fastening means to be driven in with a driving force via a driver stamp that can be displaced in the driving direction. The driving aggregate as such can be pressed against the respective workpiece by means of a pressing drive and for this is guided movably in the driving direction via an aggregate guide on the aggregate support. The pressing drive has a drive wedge extending in a wedge plane that acts on the driving aggregate to press the driving aggregate against the respective workpiece. By means of the pressing drive, the driving aggregate is pressed against the workpiece in order to achieve a constant driving depth. In order to further increase the compactness of the driving module, the drive wedge is not arranged at the middle of the driving aggregate, but rather is offset to the side relative to the driver plane of the driving aggregate.

The known driving module is still voluminous and constructively complex. In particular, it requires an additional pneumatic piston drive for the pressing drive. The pressing of the driving aggregate against the workpiece by means of the pressing drive and the following driving in of the fastening means by means of the driving aggregate necessitates a corresponding control. The operation is energy-intensive, since the entire driving aggregate is displaced for the pressing.

Furthermore, driving tools are known that can be held in the hand during use. Such manual tools drive in fastening means with a quick hammering thrust that is dampened at the end. As a result, no great reaction forces act on the user. However, the fastening means are driven into the workpiece to different depths and imprecisely aligned.

Against this backdrop, the object of the invention is to provide a driving tool that is structurally and constructively less complex for driving fastening means to a determined penetration depth into workpieces with a reduced energy demand.

The object is solved by a driving tool with the characteristics of claim 1. Advantageous embodiments of the invention are specified in the dependent claims.

The driving tool for driving fastening means into workpieces comprises:

- a main cylinder with a piston that is displaceable therein and a sealing element on the lower end with a first through hole through which a piston rod connected to the piston is guided in a sealing manner, wherein a first air chamber connected to a first air inlet for filling with air for the purpose of displacing the piston downwards is present in the main cylinder above the piston, and a second air chamber connected to a second air inlet for filling with air for the purpose of displacing the piston upwards is present below the piston,
- a pressing cylinder that carries on the lower end an outlet tool with a driving channel into which a lower section of a driving tappet connected to the piston rod projects through an upper opening and that has a lower opening at the bottom for discharging fastening means,
- a magazine for fastening means that is attached to a side opening of the driving channel in order to supply fastening means to the driving channel,
- a first holding device that has a first holding element connected to the piston rod and a second holding element connected to the pressing cylinder that are designed so that the pressing cylinder can be displaced into an upper pressing cylinder position by displacing the piston into an upper piston position and the outlet tool can be placed onto a workpiece by displacing the piston downwards from the upper piston position, and
- a first stop device that has a first stop element connected to the piston rod and a second stop element connected to the pressing cylinder that are designed to limit the downward displacement of the driving tappet in order to drive a fastening element out of the driving channel and into a workpiece by means of the driving tappet to a determined penetration depth.

By placing the outlet tool with the lower end onto the workpiece and driving in the fastening means until the first stop device comes into operation, the driving tool according to the invention ensures that the fastening means is driven into a workpiece to a determined penetration depth. Lowering and placing the outlet tool onto the workpiece is hereby achieved by displacing the piston downwards. Before the placement of the outlet tool, the driving tappet moves synchronously downwards with the outlet tool. After the placement of the outlet tool, the fastening means is driven into the workpiece to a determined driving depth by a further displacement of the piston downwards. After the fastening means has been driven in, the driving tappet is displaced back upwards by an upward displacement of the piston and the pressing cylinder is displaced back into the upper pressing cylinder position. Accordingly, the main cylinder with the piston displaceable therein achieves both the placing of the pressing cylinder onto and the lifting of the pressing cylinder away from the workpiece as well as the displacement of the driving tappet for driving in fastening means. An additional wedge mechanism and a further pneumatic drive for displacing the driving tool are not necessary. The construction can hereby be simplified, the structural volume can be reduced and energy for the operation of the driving tool can be spared. The construction ensures the sequential pressing of the outlet tool and driving in of the fastening means so that no special control is necessary for this.

The downward displacement of the piston in the main cylinder is achieved by introducing compressed air into the first air chamber through the first air inlet, wherein preferably the second air chamber is ventilated. The upward displacement of the piston in the main cylinder is achieved by introducing compressed air into the second air chamber through the second air inlet, wherein preferably the first air chamber is ventilated. The piston can be held in the upper piston position by compressed air in the second air chamber. For the displacement of the piston, compressed air is preferably drawn from an operational compressed air network. The operating pressure in such compressed air networks is often 6 bar.

According to a preferred embodiment of the invention, the first holding device comprises a first projection protruding from the piston rod radially to the outside and a second projection protruding from the pressing cylinder radially to the inside, wherein the first projection is arranged below the second projection so that in the upper piston position the first projection abuts the underside of the second projection and can be displaced downwards away from the second projection when the outlet tool is placed onto the workpiece. In this embodiment, the pressing cylinder is held in the upper pressing cylinder position by the abutment of the first projection on the underside of the second projection in the upper piston position. Through the downward displacement of the piston, the first projection is displaced downwards so that the second projection abutting it is also lowered with the pressing cylinder. The lowering can be achieved by the intrinsic weight of the pressing cylinder. When the outlet tool is placed, the piston can be moved farther downwards since the first projection is not hindered by the second projection from a further downward displacement. During the upward displacement of the piston, the first projection takes the second projection with it and therefore displaces the pressing cylinder back into the upper pressing cylinder position.

According to another embodiment, the first projection and/or the second projection is a projection that runs fully or partially about the piston axis. According to another embodiment, the first projection and/or the second projection is an annulus-shaped and/or annular disk-shaped projection.

According to another embodiment, the first projection is arranged at the bottom on a hollow cylindrical outer piston rod that is guided through the through hole in a sealing manner, the lower edge of the outer piston rod is the first stop element, the driving tappet is connected to an inner piston rod arranged concentrically in the outer piston rod, and a compression spring is arranged in the ring space between the outer piston rod and the inner piston rod as well as in the compression cylinder and is supported with the upper end on the underside of the main piston and with the lower end on the upper side of the second stop element. According to another embodiment, the compression spring is a helical spring. The compression spring holds the second projection in abutment on the first projection during the downward displacement of the piston from the upper piston position until the outlet tool is placed on the workpiece. Lowering the outlet tool onto the workpiece can hereby take place particularly quickly. Moreover, an exact orientation of the pressing cylinder to the main cylinder can be ensured by the abutment of the second projection on the first projection. After the placement of the outlet tool onto the workpiece, the compression spring is compressed as the fastening means is driven in. During the upward displacement of the piston, the energy saved in the compression spring is used. In addition, compressed air is required in order to displace the piston into the upper piston position. During the upward displacement of the piston, the driving tappet is first retracted in the driving channel and then the pressing cylinder is lifted. In the following embodiment, the driving tappet and the pressing cylinder are lifted simultaneously from the beginning of the upward displacement of the piston on, whereby time is spared and more fastening means can be driven in per unit time.

In this embodiment, a second holding device is present that has a third holding element connected to the piston rod and a fourth holding element connected to the pressing cylinder that are designed so that they hold the piston rod firmly to the pressing cylinder in the case of abutment of the first stop element on the second stop element so that when the piston is displaced upwards the pressing cylinder is displaced upwards with it. Moreover, a third holding device is present that has a fifth holding element on the main cylinder and a sixth holding element on the pressing cylinder that are designed so that they can be connected to each other through upward displacement of the pressing cylinder, whereby a further upward displacement of the pressing cylinder is prevented by further displacing the piston upwards and the connection between the third and fourth holding elements of the second holding device is eliminated. Finally, a retracting device is present that is designed so that it eliminates the connection between the fifth and the sixth holding element when the first holding element hits the second holding element. In this embodiment, the driving tappet is displaced upwards after the driving in when the piston is displaced upwards and the pressing cylinder is also immediately displaced upwards by the second holding device firmly holding the pressing cylinder against the piston rod. Only once the third holding device comes into operation is the pressing cylinder held in the reached position and the effect of the second holding device with the further upward displacement of the piston eliminated. When the third holding device comes into operation, the pressing cylinder does not fall down if the piston is no longer connected to the pressing cylinder as a result of the elimination of the effect of the second holding device. Finally, the effect of the third holding device is eliminated by means of the retracting device when the first holding element hits the second holding element. As a result, the lowering of the outlet tool is not prevented by the third holding device. The pressing cylinder is held by the first holding device in the upper pressing cylinder position and the driving tool is ready to lower the outlet tool before driving in a further fastening means.

According to another embodiment, the second holding device is a first magnetic coupling, wherein a first magnetic coupling element is connected to the piston rod and a second magnetic coupling element is connected to the pressing cylinder. According to another embodiment, the first magnetic coupling element is the first stop element and the second magnetic coupling element is the second stop element. According to another embodiment, the first magnetic coupling element is circular disk-shaped and/or the second magnetic coupling element is circular disk-shaped. According to another embodiment, the first magnetic coupling element has at least one (permanent) magnet and the second magnetic coupling element has at least one ferromagnetic element or vice versa.

According to another embodiment, the third holding device comprises a second magnetic coupling, wherein a third magnetic coupling element is connected to the main cylinder and a fourth magnetic coupling element is connected to the pressing cylinder. Moreover, the third holding device comprises a second stop device with a third stop element on the main cylinder and a fourth stop element on the pressing cylinder that are designed so that they prevent a further upward displacement of the pressing cylinder when they hit each other. According to another embodiment, the third magnetic coupling element is annular disk-shaped and/or the fourth magnetic coupling element is annular disk-shaped. According to another embodiment, the third magnetic coupling element comprises at least one (permanent) magnet and/or the fourth magnetic coupling element comprises at least one ferromagnetic component or vice versa. According to another embodiment, the third stop element is the underside of the sealing element and the fourth stop element is an annular disk-shaped stop element on the upper end of the pressing cylinder protruding radially to the inside. This is, according to another embodiment, simultaneously the fourth magnetic coupling element.

According to another embodiment, the retracting device comprises pins protruding vertically from the upper side of the second holding element and the second holding element can be displaced in the vertical direction until it abuts the sixth holding element, wherein the pins can be displaced upwards with their upper ends over the sixth holding element in order to push the fifth holding element away from the sixth holding element.

According to another embodiment, the third magnetic coupling element is held on a vertical guide device that is designed so that the third magnetic coupling element can be displaced vertically upwards starting from a lower stop position, wherein the third magnetic coupling element can be coupled with the fourth magnetic coupling element in the lower stop position and can be pushed away upwards from the fourth magnetic coupling element by the pin. In the lower stop position, the fourth magnetic coupling element can be coupled with the third magnetic coupling element. The pressing cylinder is then held firmly in the reached position so that it does not fall down when the second holding device is released. The second magnetic coupling is disengaged by means of the pins when the first stop element hits the second stop element. The first and second stop element resting against each other prevent the pressing cylinder from falling down after the decoupling of the second magnetic coupling device. The piston is displaced to the upper piston position, wherein the third magnetic coupling element is taken with it upwards. When the second holding element abuts the fourth magnetic coupling element, the piston has reached the upper piston position.

According to another embodiment, the second holding device comprises at least one groove in a lower section of the driving tappet and at least one locking element on the outlet tool that, when the first stop element abuts the second stop element, locks to the groove and is designed so that the locking is released when the fifth and the sixth holding element are connected to each other. In this embodiment, the piston is connected to the pressing cylinder via the locking between the driving tappet and locking element. The first magnetic coupling is dispensed with. According to another embodiment, the third holding device is designed as a second magnetic coupling.

According to another embodiment, a nail centering is present below on the outlet tool that has a centering opening below the driving channel that is limited by at least one guide element movable in the radial direction that is pretensioned by a spring device in the radial direction towards the centering channel, wherein the guide element is simultaneously the locking element of the third holding device. A nail centering is hereby used to realize the second holding device.

According to another embodiment, the nail centering comprises a centering housing in which at least one circle of balls is arranged, between which the centering opening is defined, wherein an elastic snap ring, Seeger circlip ring, O-ring or other elastic ring acts to the outside on the balls as a spring device. This nail centering is suitable for centering nails with a single nail shaft and a nail head or pins. When the nail shaft passes through the centering opening, the balls are pushed apart somewhat from each other radially against the effect of the elastic ring so that the nail shaft is centered. When the nail head passes through, the balls are pushed wider apart from each other, and after the nail head has passed, they are pressed against the following driving tappet by the elastic ring. Finally, the balls lock into the groove of the driving tappet. The elastic ring and the balls are designed so that a locking of the balls in the groove can take place. The locking connection is released when the piston is displaced further upwards after the sixth holding element hits the fifth holding element. According to another embodiment, the underside of the centering housing is the lower end of the outlet tool, with which the pressing cylinder can be placed onto the workpiece. According to another embodiment, the underside of the centering housing is annulus-shaped. Marks from the outlet tool on the workpiece are hereby avoided since the centering housing can be placed onto the workpiece with a large area. Furthermore, driving the fastening means perpendicularly to the workpiece surface is promoted by the large-area abutment of the centering housing.

According to another embodiment, the second stop element is held by a setting device in the pressing cylinder, wherein the setting device is designed to set the vertical location of the second stop element in the pressing cylinder. By means of the setting device, the penetration depth of the fastening means in the workpiece can be set.

According to another embodiment, the second stop element is a ring with an external thread that is screwed into an internal thread of an adjusting ring, wherein the adjusting ring is held between a first and a second mounting element in the pressing cylinder so that it can be rotated in the pressing cylinder but cannot be displaced in the vertical direction, and a linear guide is present which allows a displacement of the ring in the vertical direction but hinders it from rotating about a vertical axis. A precise setting of the penetration depth is hereby particularly simply enabled.

According to another embodiment, the adjusting ring has first blind bores at various peripheral positions on its outer circumference, into which a pin-shaped tool can be inserted from the outside through at least one slot in the pressing cylinder. The adjusting ring can be shifted by rotating a tool that is plugged into a first blind bore. After the exhaustion of the pivot range in the slot, the tool can be replugged into another first blind bore in order to rotate the adjusting ring further, if applicable.

Finally, the object of the invention is a driving tool according to the invention, in particular a driving tool according to the invention according to one of claims 1 to 14, in particular a driving tool according to the invention according to one of the preceding embodiments, held on a woodworking bridge or on another displacement device or on a stationary tool support.

The invention is explained in greater detail below based on the accompanying drawings of exemplary embodiments. In the drawings.

Figure 12A:
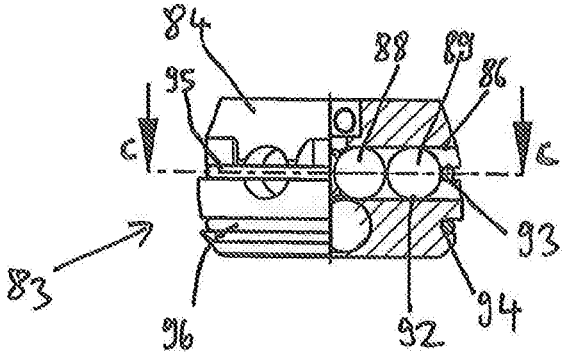
Figure 12B:
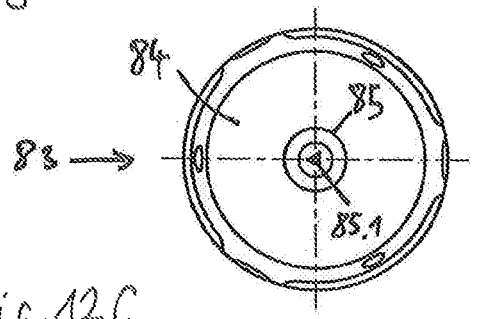
Figure 12C:
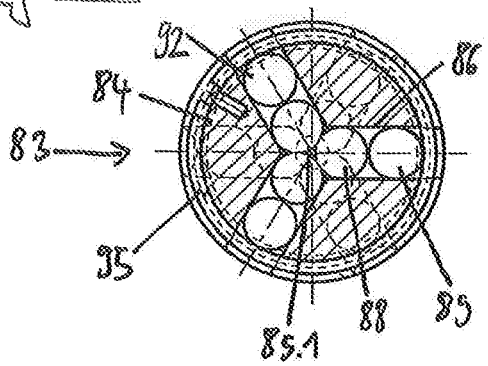
Figure 13:
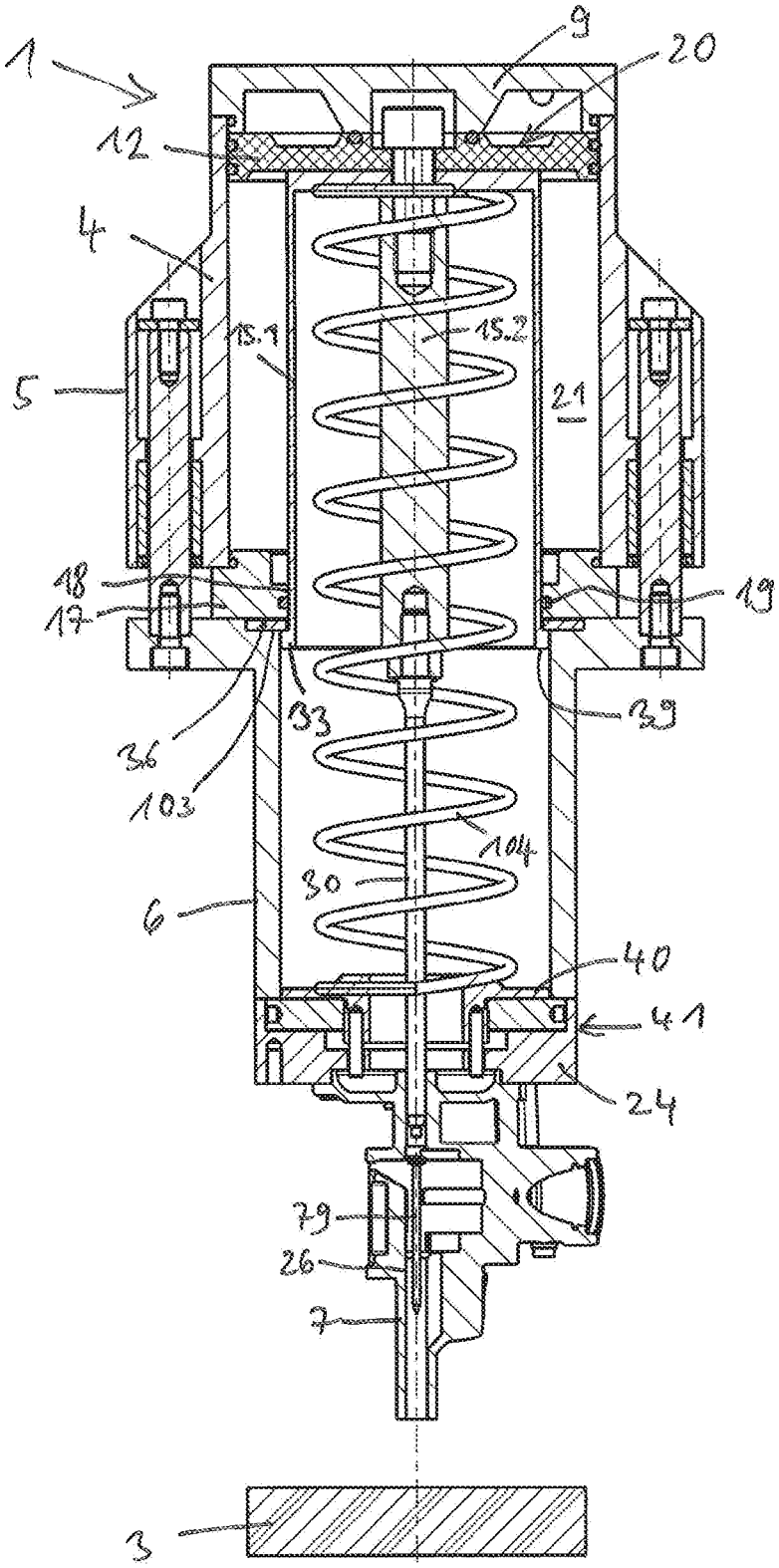
Figure 14:
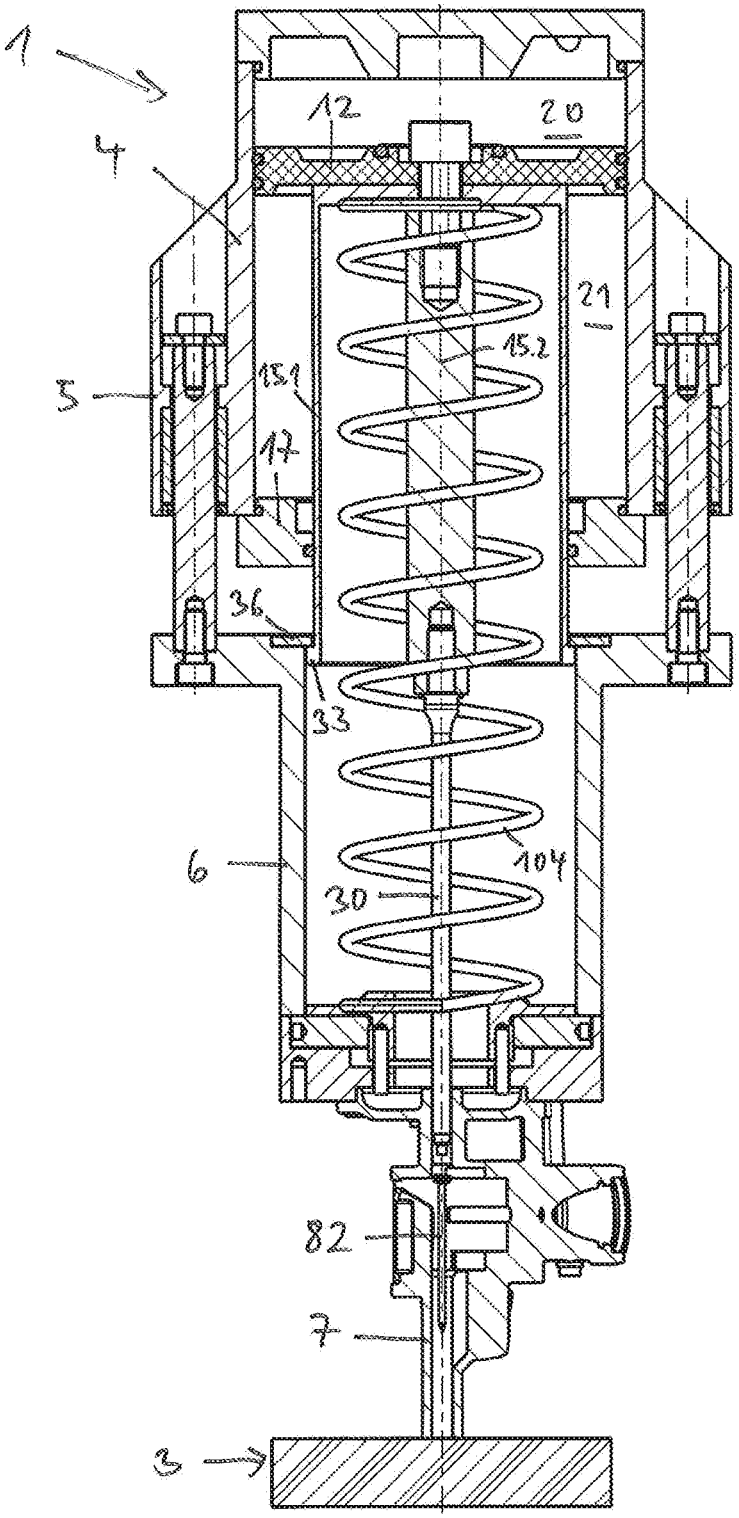
Figure 15:
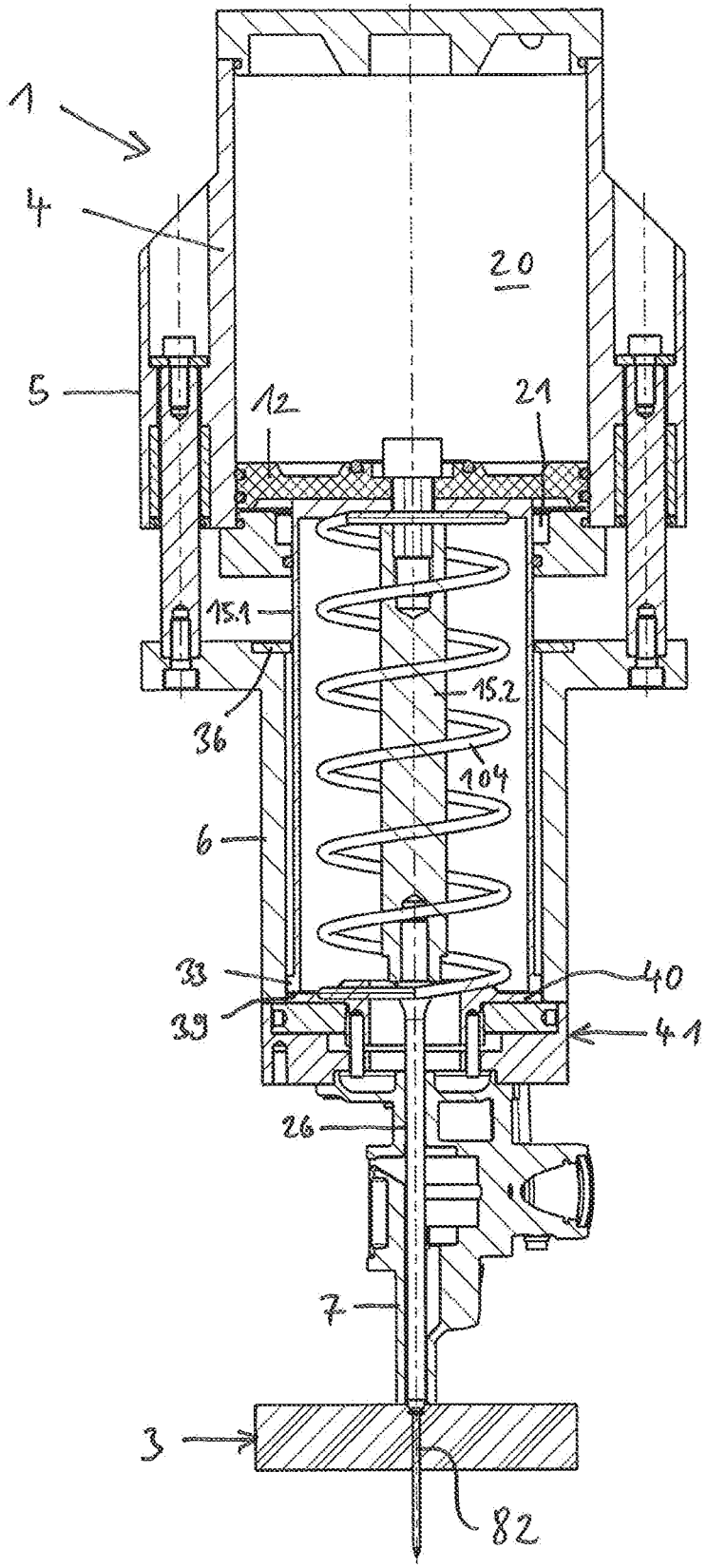
Figure 16:
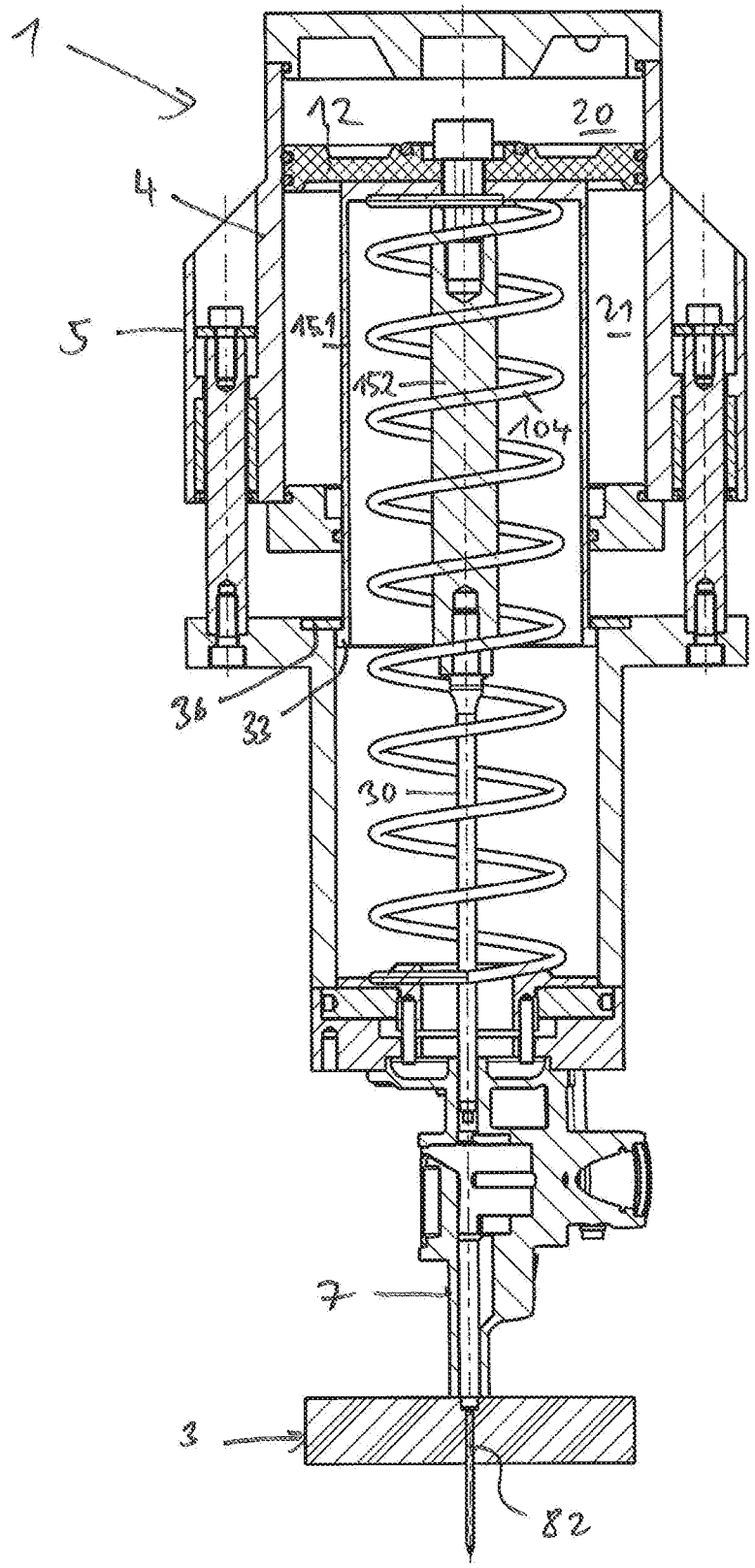
Figure 17:
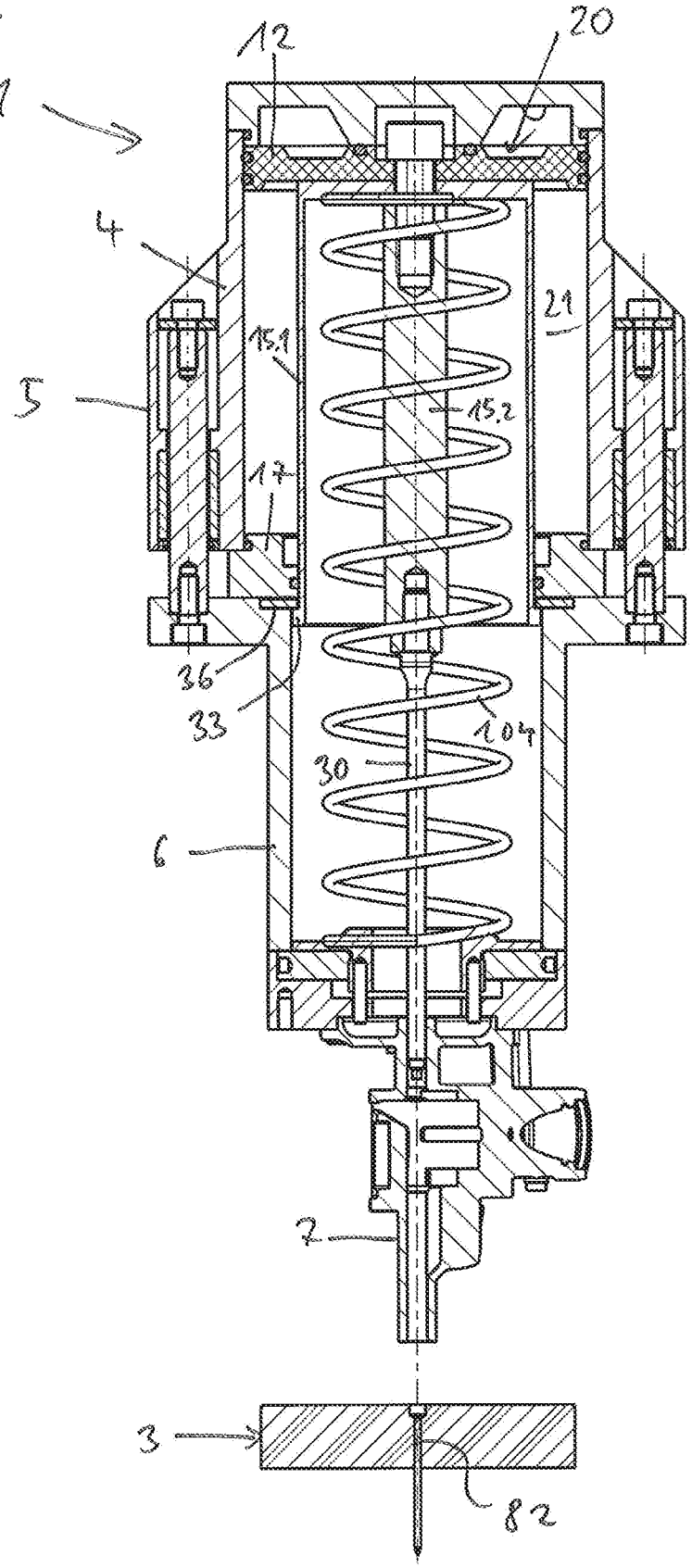

FIG. 12*a-c* shows the nail centering of the second driving tool in a partially cut side view (FIG. 12*a*), in a plan view (FIG. 12*b*) and in a section along the line c-c from FIG. 12*a* (FIG. 12*c*);

FIG. 13 shows a third driving tool comprising a compression spring with the piston in the upper piston position;

FIG. 14 shows a vertical section of the third driving tool with the outlet tool placed onto a workpiece;

FIG. 15 shows a vertical section of the third driving tool with a nail just fully driven into a workpiece;

FIG. 16 shows a vertical section of the third driving tool with mechanical coupling of the piston and pressing cylinder;

FIG. 17 shows a vertical section of the third driving tool with the piston in the upper piston position.

In the present application, the indicators "up" and "down" and indicators derived therefrom such as "above" and "below" and "vertical" and "horizontal" refer to an orientation of the driving tool with the main cylinder over the pressing cylinder and the lower opening of the outlet tool on the lower end of the driving tool.

Figure 1:
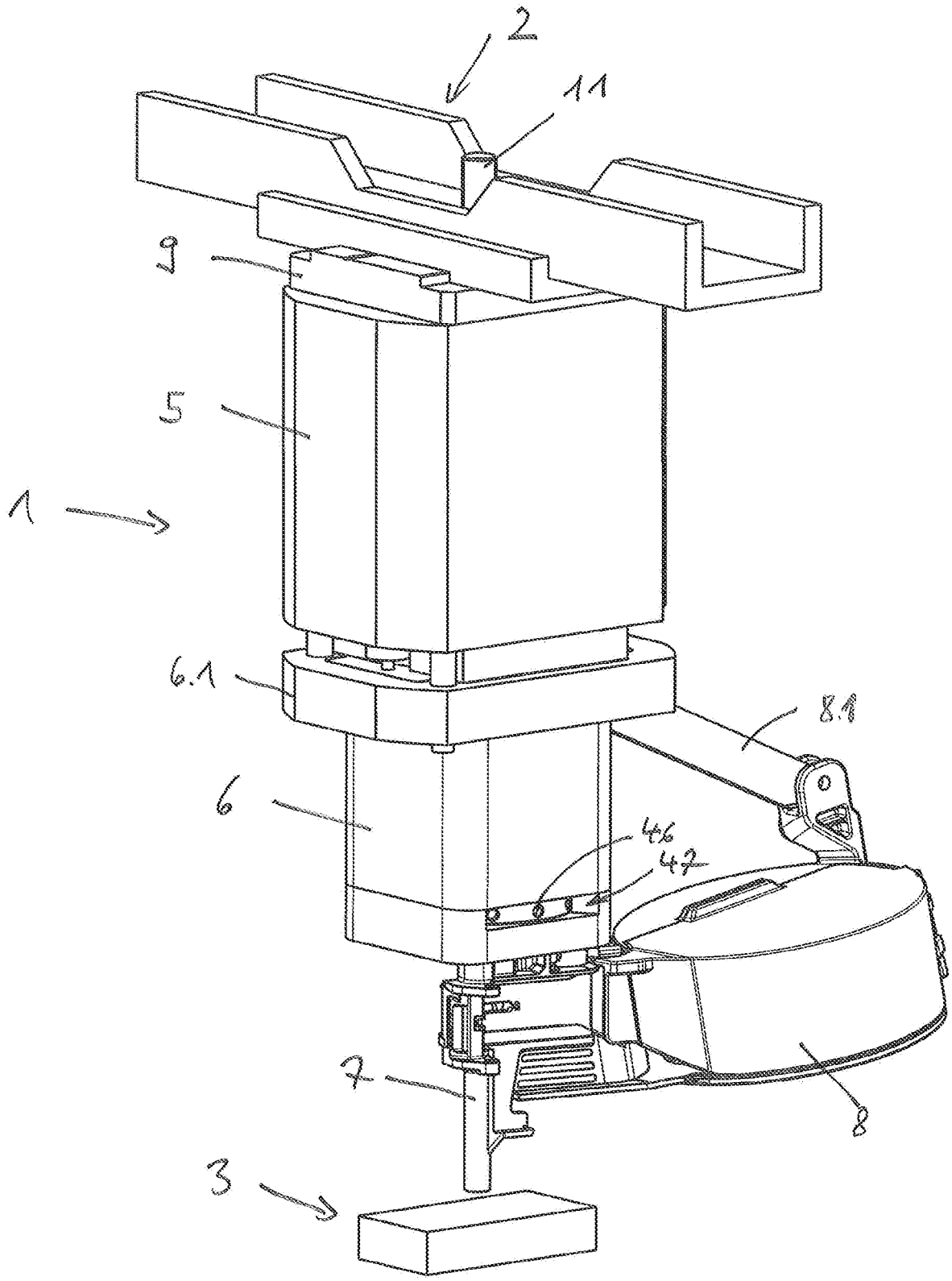
FIG. 1 shows a first driving tool with a first and a second magnetic coupling on a woodworking bridge in a perspective view transversely from the front and from the side.

According to FIG. 1, a driving tool 1 is arranged on a bridge 2 above a workpiece 3. Only a horizontal support of the bridge 2 is shown. Overall, the bridge is portal-shaped, wherein the two vertical posts are guided displaceably in the horizontal direction on rails on both sides of a workbench.

According to FIGS. 1 and 2, the driving tool 1 comprises a main cylinder 4 in a housing 5, a pressing cylinder 6 arranged below the housing 5, an outlet tool 7 protruding downwards from the underside of the pressing cylinder 6, and a magazine 8 arranged to the side of the outlet tool.

The main cylinder 4 is designed circular-cylindrically or ovally on the inside. The main cylinder 4 is closed at the top by a lid 9. In a central, hexagonal recess 10 in the underside of the lid 9, the hexagon head of a first screw 11 sits, the threaded shaft of which passes through a central bore in the lid 9 and protrudes from the lid 9 at the top. The first screw 11 serves for fastening to the bridge 2.

A piston 12 is guided vertically displaceably in the main cylinder 4. The piston is sealed off from the main cylinder 4 with first and second O-rings 13, 14.

A piston rod 15 protrudes downwards from the underside of the piston 12. The piston rod 15 is connected to the piston 12 by means of a second screw 16.

Underneath, the main cylinder 4 has a sealing element 17 that is designed as a first floor plate. The sealing element 17 has a first through hole 18 in the center in the form of a guide bushing, through which the piston rod 15 passes through so that it stands out from the sealing element 17 at the bottom.

A third O-ring is held in a groove on the outer circumference of the sealing element 17 that seals off the sealing element from the main cylinder 4.

The piston rod 15 is sealed off from the sealing element 17 by a fourth O-ring held in the sealing element 17.

Above the piston 12 a first air chamber 20 is present in the main cylinder 4 and below the piston 12 a second air chamber 21 is present. The first air chamber 20 is connected to a first air inlet 22 accessible from the outside and the second chamber is connected to a second air inlet 23 accessible from the outside.

The pressing cylinder 6 is substantially box-shaped on the outside and has a round or oval cross-section on the inside. The pressing cylinder 6 has a second floor plate 24 at the bottom with a second through hole 25. The pressing cylinder 6 has an outwardly protruding flange 6.1 at the top.

The outlet tool 7 is fastened to the underside of the second floor plate 24. It has a driving channel 26 that has an upper opening 27 at the top, has a lower opening 28 on the lower end of the outlet tool 7, and has a side opening 29 on the side. The barrel-shaped magazine 8 for fastening means is attached with its output opening to the side opening 29.

A driving tappet 30 projects with a lower section through the second through hole 25 and the upper opening 27 into the driving channel 26. The upper section of the driving tappet 30 is fastened to the piston rod 15 at the bottom. For this, the driving tappet 30 has an external thread 31 at the top that is screwed into a threaded bore on the underside of the piston rod 15.

A first holding device 32 has a first holding element 33 protruding radially from the piston rod 15. It is hereby a circular disk-shaped projection running around the central axis of the piston rod. The first holding element 33 has a pot-shaped shape 34 in the center into which the lower end of the piston rod 15 is inserted. The driving tappet 30 passes through a central hole of the shape and is screwed into the piston rod. A collar 35 on the outer circumference of the driving tappet 30 abuts the underside of the shape 34 so that the first holding element 33 is fixed between the piston rod 15 and driving tappet 30.

The first holding device 32 has a second holding element 36 connected to the pressing cylinder 6. The second holding element 36 is a projection protruding radially to the inside from the pressing cylinder 6. This projection is designed as an annular disk that is arranged vertically displaceably in a first expansion 37 on the upper end of the pressing cylinder 6.

A first stop device 38 has a first stop element 39 connected to the piston rod and a second stop element 40 connected to the pressing cylinder 6. The first holding element 33 is simultaneously the first stop element 39. The second stop element 40 is a ring that is held by a setting device 41 near the second floor plate 24.

The setting device 41 comprises an adjusting ring 42 that has an internal thread 43 into which the second stop element 40 is screwed with an external thread 44. In the region of the external thread 44, the second stop element 40 has a reduced outer diameter.

The underside of the adjusting ring 42 abuts the upper side of the second floor plate 24. At the top, the adjusting ring 42 is guided on a shoulder 45 of the pressing cylinder 6. Accordingly, the adjusting ring 42 is caught between the shoulder 45 and the second floor plate 24 so that it cannot be displaced vertically but can be rotated only about the vertical axis.

The adjusting ring 42 has multiple first blind bores 46 on the outer circumference into which a pin can be inserted from the outside through a slot 47 in the pressing cylinder 6 for adjusting the adjusting ring 42 (FIG. 1). The second stop element 40 has multiple vertical threaded bores 48 on the underside into which studs 49 are screwed that are axially displaceably guided in second bores 24.1 of the second floor plate 24. The second bores 24.1 of the second floor plate 24 and the studs 49 form a linear guide 50.

By rotating the adjusting ring 42, the second stop element 40 can be displaced in the vertical direction since it is prevented by the studs 49 from rotating with the adjusting ring 42.

Furthermore, a second holding device 51 is present that has a third holding element 52 connected to the piston rod 15 and a fourth holding element 53 connected to the pressing cylinder 6. The second holding device 51 is a first magnetic coupling 54 that has a first magnetic coupling element 55 connected to the piston rod 15 and a second magnetic coupling element 56 connected to the pressing cylinder 6. The first magnetic coupling element 55 has permanent magnets 57 that are fastened to the underside of the first stop element 39 by means of third screws 58 and first nuts 59. The second magnetic coupling element 56 is the second stop element 40 that consists of a ferromagnetic material. By putting the first stop element 39 against the second stop element 40, the first and second magnetic coupling elements 55, 56 can be coupled with each other.

Furthermore, a third holding device 60 is present that has a fifth holding element 61 on the main cylinder 4 and a sixth holding element 62 on the pressing cylinder 6. The third holding device 60 comprises a second magnetic coupling 63 that has a third magnetic coupling element 64 connected to the main cylinder 4 and a fourth magnetic coupling element 65 connected to the pressing cylinder 6. The third magnetic coupling element 64 has circular disk-shaped permanent magnets 66 that are fastened by means of fourth screws 67 to the lower ends of first bars 68 that are guided in vertical first bores 69 of the housing 5.

On the upper ends of the bars 68, first disks 71 are fastened, by means of fifth screws 60, that protrude to the outside radially in relation to the bars 68. The first disks 71 are arranged in second expansions 72 of the first bores 69 and limit the downward displacement of the first bars 68 by abuting an attachment on the lower end of the second expansions 72. The upward displacement of the first bars 68 is limited by the abutment of the permanent magnets 66 on the underside of the housing 5 protruding radially in relation to the first bars 68. The fourth magnetic coupling element 65 is designed as an annular disk from a ferromagnetic material and is fastened on the upper end of the pressing cylinder 6.

The third holding device 60 comprises a second stop device 73 that has a third stop element 74 on the main cylinder 4 and a fourth stop element 75 on the pressing cylinder 6. The fourth stop element 75 is a part of the fourth magnetic coupling element 65 protruding radially to the inside and the third stop element 74 is the underside of the sealing element 17.

The fourth magnetic coupling element 65 limits the upward displacement of the pressing cylinder 6 by abutting the underside of the sealing element 17. Furthermore, it covers the first expansion 37 of the pressing cylinder 6 at the top and limits the upward displacement of the second holding element 36. The downward displacement of the second holding element 36 is limited by the floor of the first expansion 37.

Furthermore, a retracting device 76 with vertically oriented pins 77 is present. The pins 77 protrude upwards from the upper side of the second holding element 36.

The pins 77 engage with holes 78 of the fourth magnetic coupling element 65. When the second holding element 36 is located in the lower location, the pins 77 do not protrude over the upper side of the fourth magnetic coupling element 65 (FIG. 3). By displacing the second holding element 36 upwards, the pins 77 are pushed out of the holes 78 at the top (FIG. 2).

The flange 6.1 of the pressing cylinder 6 is fastened to second bars 80, by means of sixth screws 79, that are guided in vertical third bores 81 in the housing 5. A holder 8.1 of the magazine 8 is firmly clamped between a sixth screw 79 and the flange 6.1.

Figure 2:
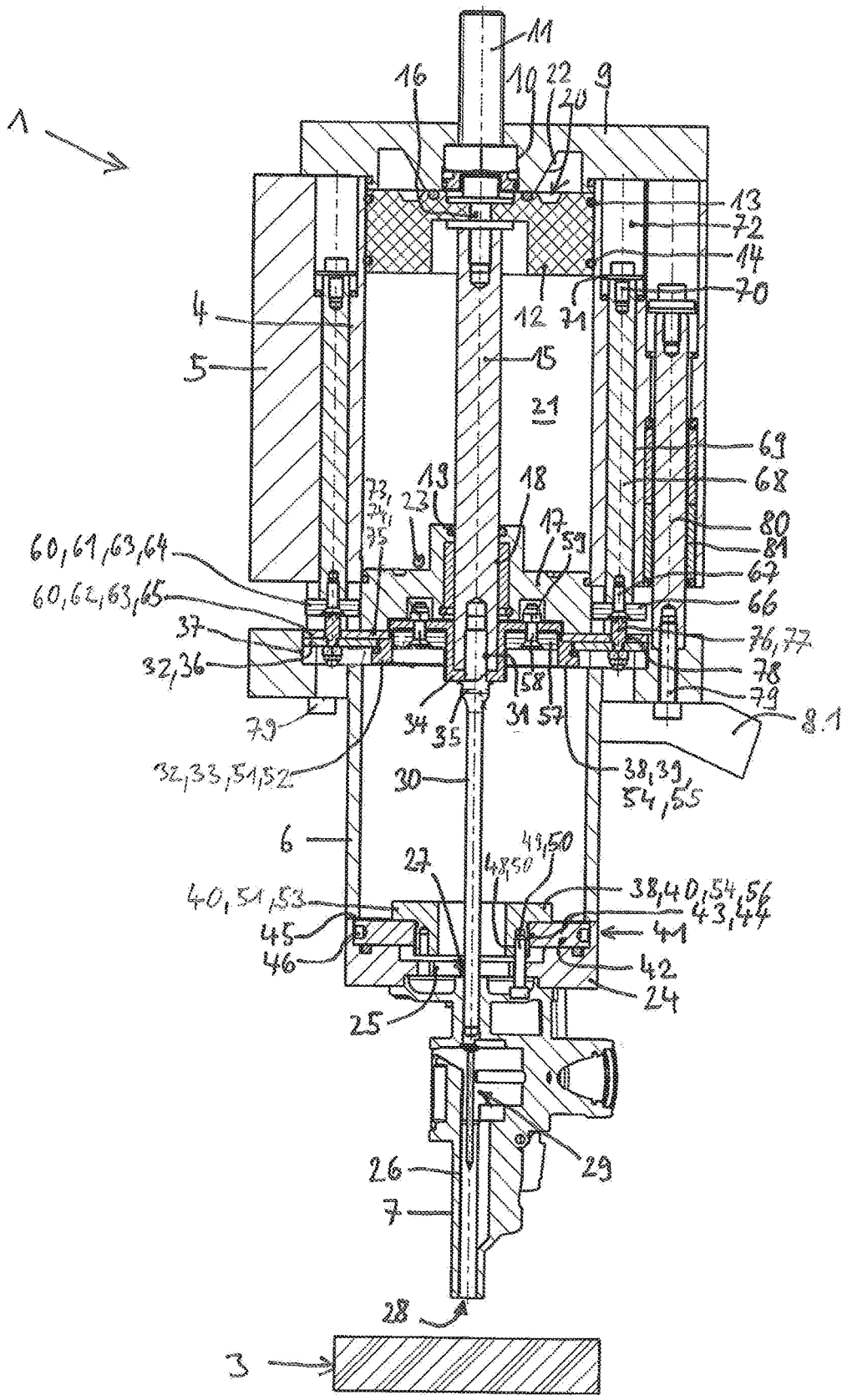
FIG. 2 shows a vertical section of the first driving tool with the piston in the upper piston position.
Figure 3:
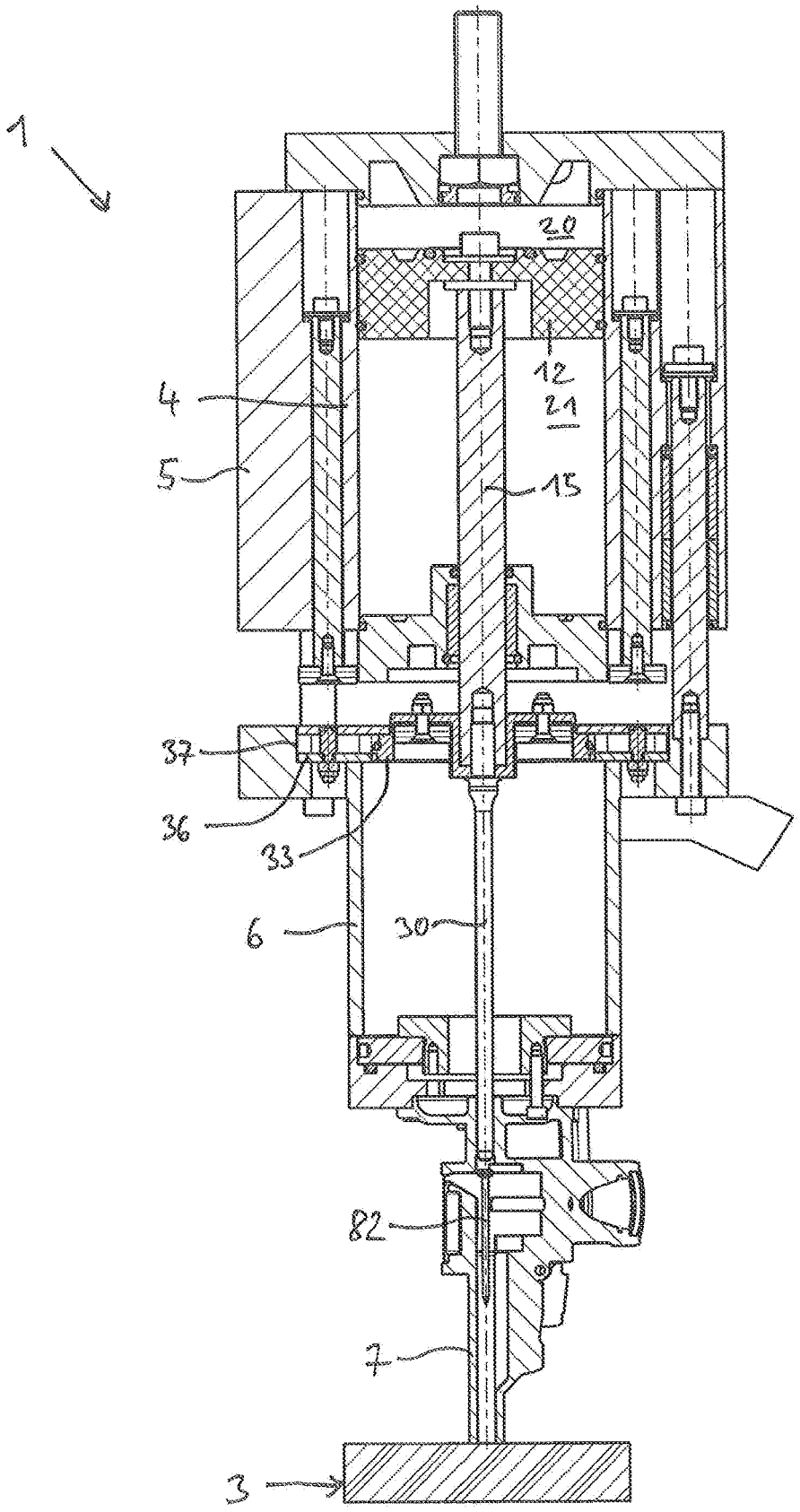
FIG. 3 shows a vertical section of the first driving tool with the outlet tool lowered onto a workpiece.

FIGS. 1 and 2 show the first driving tool 1 in an initial position in which the outlet tool 7 does not sit on the workpiece 3. The piston 12 is held in the upper piston position by compressed air fed into the second air chamber 21 in which it abuts the lid 9. The first holding element 33 is lifted maximally by the piston rod 15 so that the second holding element 36 abuts the underside of the sixth holding element 62. The third magnetic coupling element 64 is pushed away from the fourth magnetic coupling element 65 by the pins 74.

According to FIG. 3, the piston 12 and therefore the first holding element 33 is displaced downwards by feeding compressed air into the first air chamber 20 and ventilating the second air chamber 21. With the first holding element 33, the second holding element 36 and therefore the pressing cylinder 6 wanders downwards until the outlet tool 7 sits with the lower end on the workpiece 3. A defined initial location for driving a nail 82 or another fastening means into the workpiece 3 is hereby given.

Figure 4:
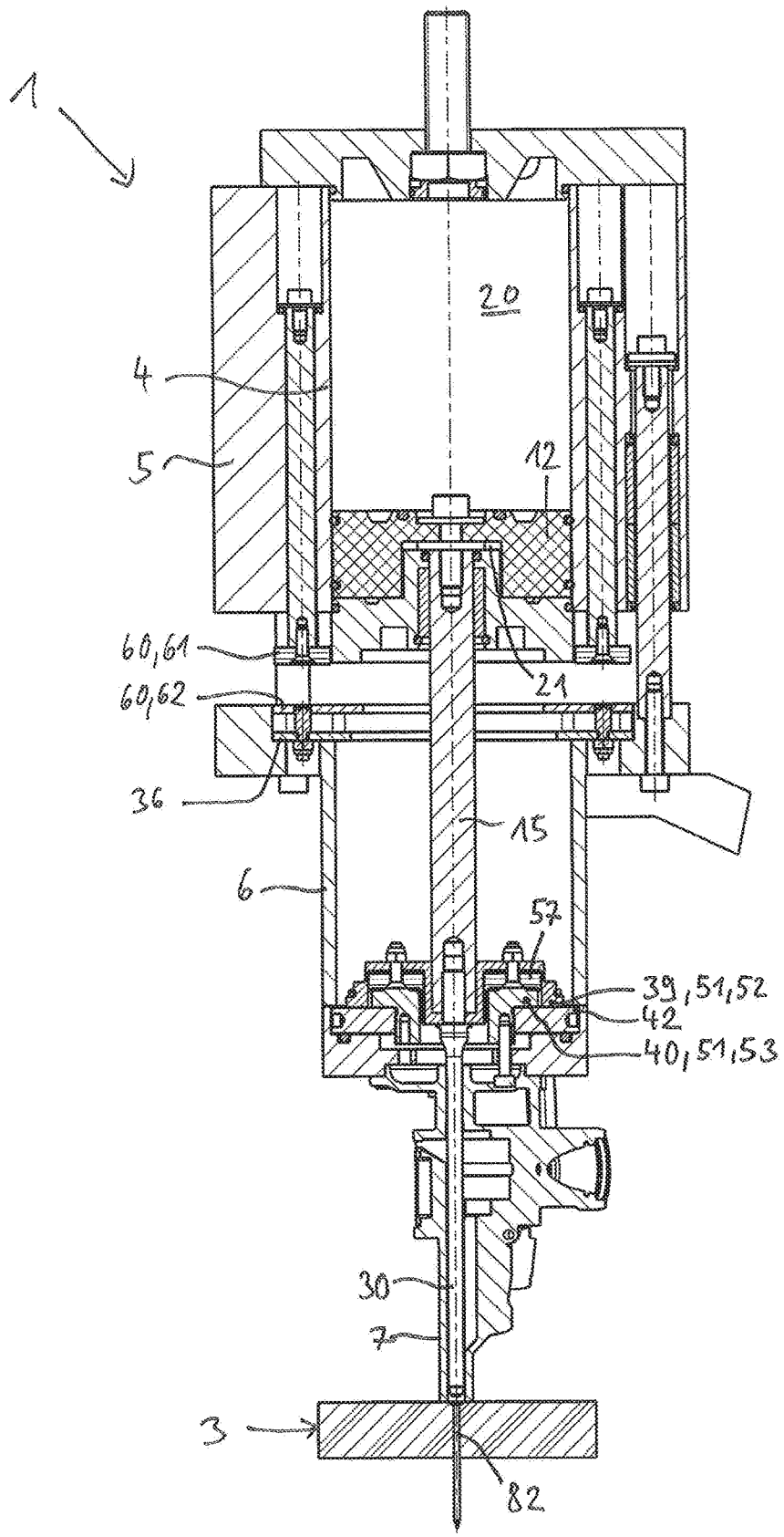
FIG. 4 shows a vertical section of the first driving tool with a just fully driven in nail.

Afterwards, according to FIG. 4, further compressed air is introduced into the first air chamber 20 and a nail 82 fed into the driving channel 26 from the magazine 8 is driven into the workpiece 3 until the first stop element 39 abuts the second stop element 40. Then the nail 82 is driven into the workpiece 3 to a defined driving depth. The penetration depth is determined by the vertical location of the second stop element 40 that can be set from the outside by adjusting the adjusting ring 42.

With the abutment of the first stop element 39 against the second stop element 40, the first magnetic coupling 51 is simultaneously coupled since the first stop element 39 is simultaneously the first magnetic coupling element 52 and the second stop element 40 is simultaneously the second magnetic coupling element 53.

Figure 5:
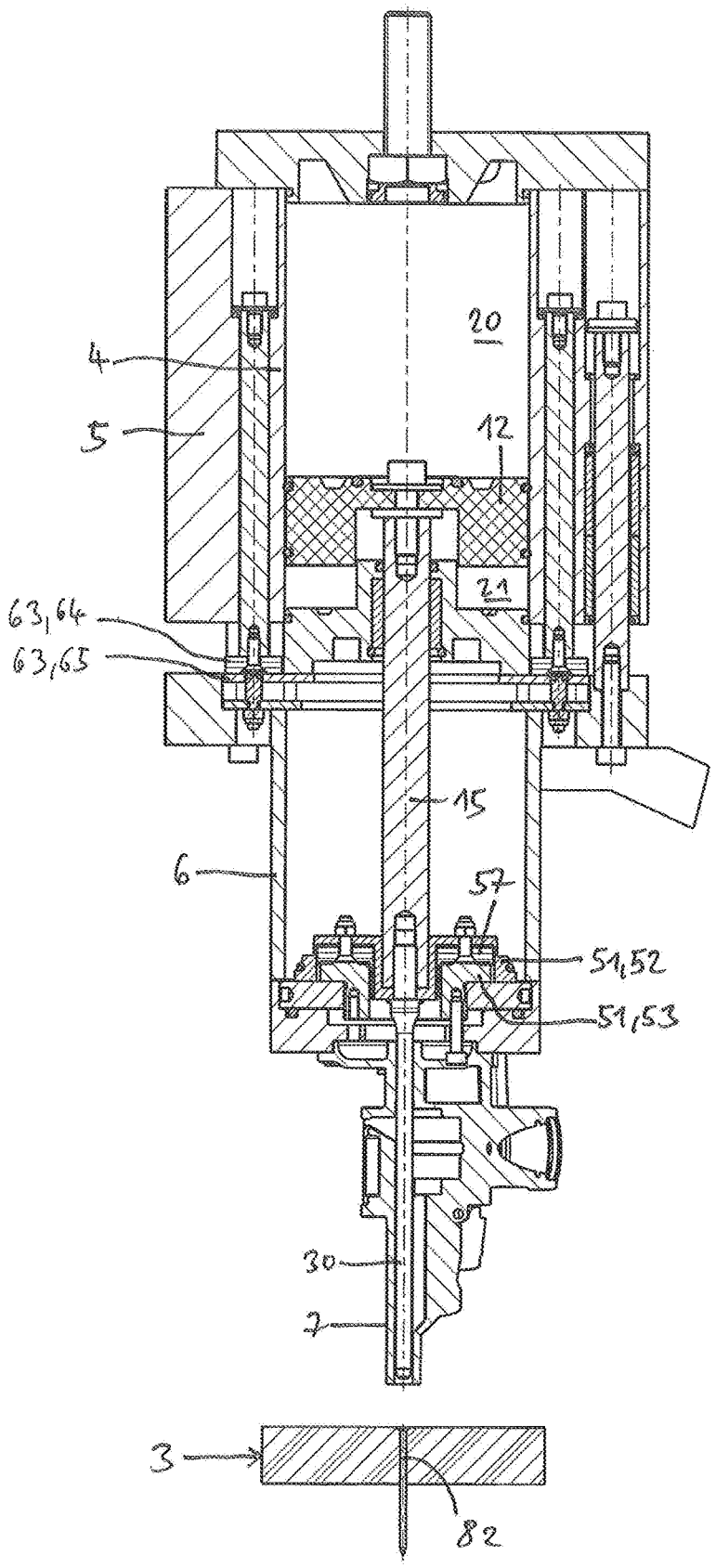
FIG. 5 shows a vertical section of the first driving tool with the outlet tool pulled away from the workpiece and magnetically coupled main and pressing cylinders.

Afterwards, according to FIG. 5, the piston 12 proceeds upwards by introducing compressed air into the second air chamber 21 and ventilating the first air chamber 20, wherein the first magnetic coupling 51 takes the pressing cylinder 6 with it upwards. The driving tappet 30 is lifted synchronously with the outlet tool 7. The fourth magnetic coupling element 65 is coupled with the third magnetic coupling element 64 of the second magnetic coupling 63.

Figure 6:
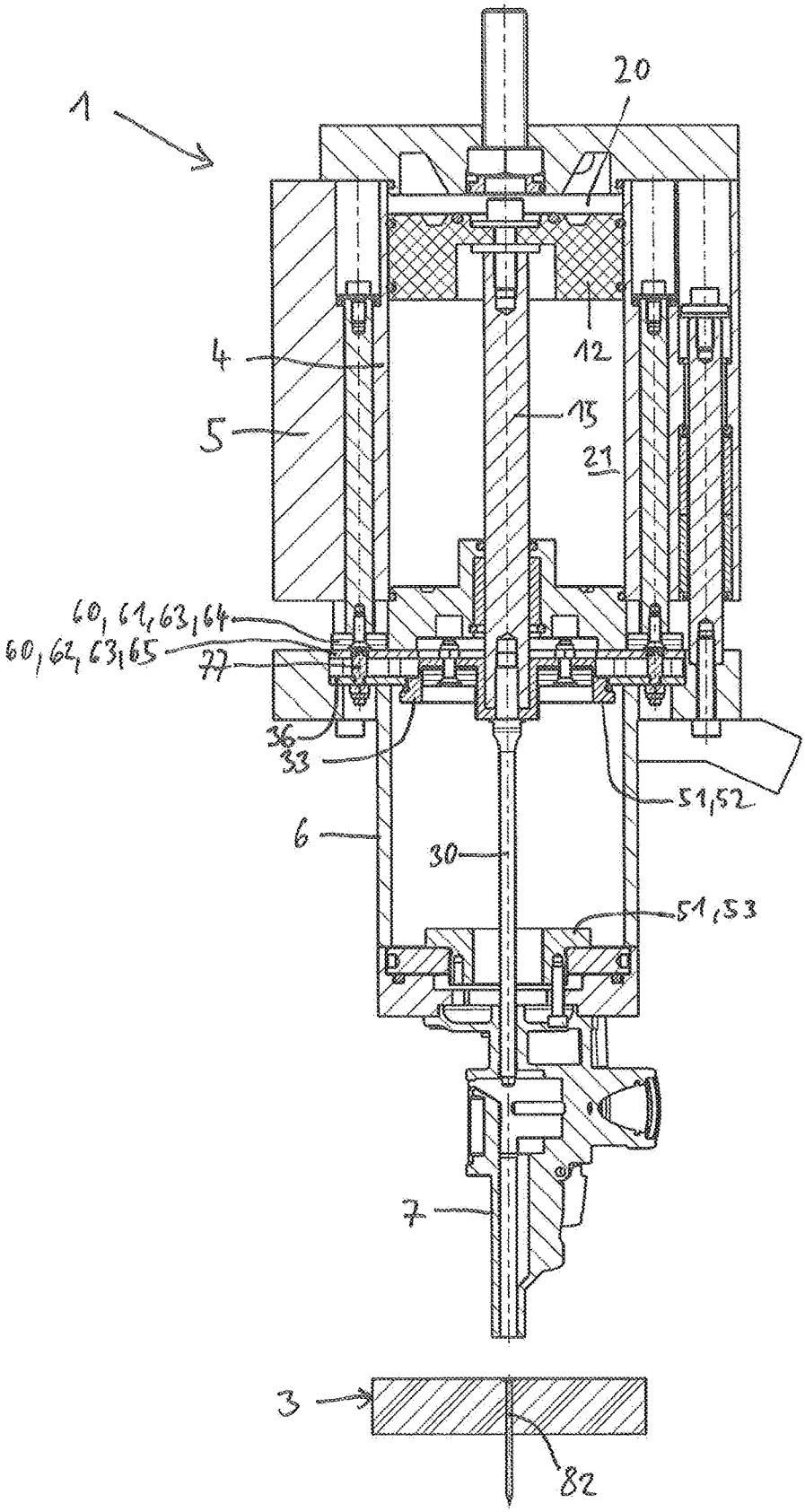
FIG. 6 shows a vertical section of the first driving tool at the beginning of the mechanical coupling and releasing of the magnetic coupling of the main cylinder and pressing cylinder.

According to FIG. 6, the phase described before is ended in that the pins 77 hit the third magnetic coupling element 64 of the second magnetic coupling 63 and release it from the fourth magnetic coupling element 65. After the release of the first magnetic coupling 51, the pressing cylinder 6, according to FIG. 2, does not fall back since this is prevented by the abutment of the first holding element 33 against the second holding element 36 and the abutment of the second holding element 36 against the sixth holding element 62. After feeding a further nail 82 from the magazine 8 into the driving channel 26, the driving tool 1 is ready for another driving process.

The second driving tool 1 from FIGS. 7 to 12 has in contrast to the first driving tool no first magnetic device 54. The second driving tool is, however, provided with a nail centering 80 on the lower end of the outlet tool 7.

The nail centering 83 has a circular disk-shaped centering housing 84 with a vertical centering channel 85 that is aligned with the driving channel 26. In the centering housing 84, two concentric circles 88, 89, 90, 91 of balls 92 are arranged in each of two horizontal planes over each other in chambers 86, 87 that are designed as radial ball guide channels. The balls 92 of the two inner circles 88, 90 arranged over each other protrude partially into the centering channel 85, wherein adjacent balls 92 support each other. Adjacent balls 92 of the outer circles 89, 91 and of the inner circles 88, 90 abut each other on their equator.

The centering housing 84 has on the outer circumference a circumferential groove 93, 94 in the equatorial plane of the upper circles 88, 89 and of the lower circles 90, 91 respectively that reach into the chambers 86, 87 in the centering housing 84 in which the balls 92 are arranged. A snap ring 95, 96 sits in each groove 93, 94 that pushes under elastic pretensioning against the balls 92 of the outer circle 89, 91, which then push the balls of the inner circles 88, 90 into the centering channel 85 until they abut each other so that a centering opening 85 remains between the balls 92 of the inner circles 88, 90. In addition, O-rings 97, 98 are arranged between the balls 92 of the inner circles 88, 90 and of the outer circles 89, 91 in order to compensate for different diameters of standardized balls 92 and snap rings 95, 96 so that the balls 92 of the inner circles 88, 90 each abut each other.

Moreover, the driving tappet 30 is provided in a lower section with circumferential grooves 101, 102 arranged over each other. In the vertical section, the grooves 101, 102 are lightly rounded, corresponding to the outer contour of the balls 92 of the nail centering 83. The spacing of the two grooves 101, 102 corresponds to the spacing from each other of the circles 88, 89, 90, 91 that are arranged over each other.

Figure 7:
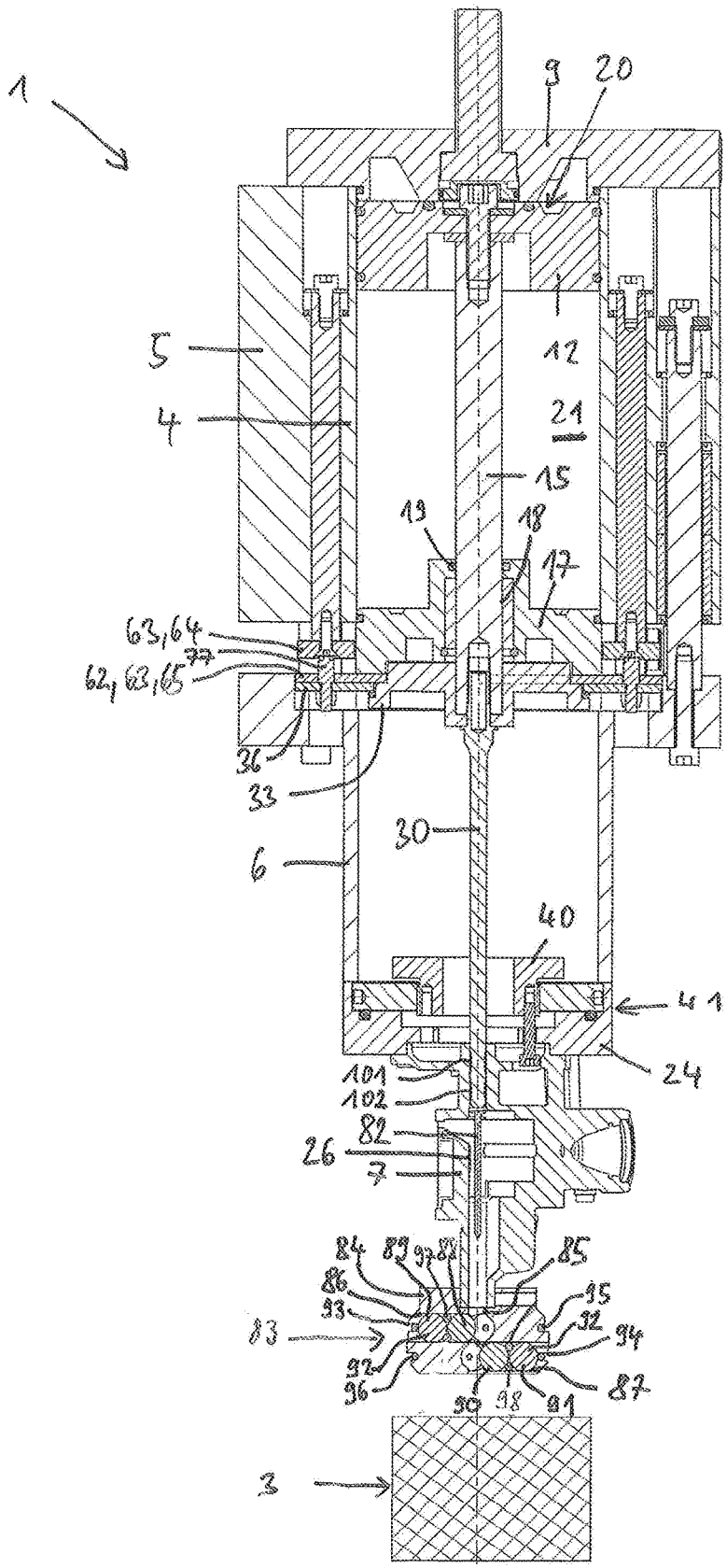
FIG. 7 shows a vertical section of a second driving tool comprising a locking between the nail centering and driving tappet with the piston in the upper piston position.

Before the nail 82 is driven in, the initial location of the second driving tool 1 from FIG. 7 corresponds to the initial location from FIG. 2. The second magnetic coupling 63 is also disengaged in the case of the second driving tool 1, and the first holding element 33 abuts the second holding element 36 and the second holding element 36 abuts the sixth holding element 62.

Figure 8:
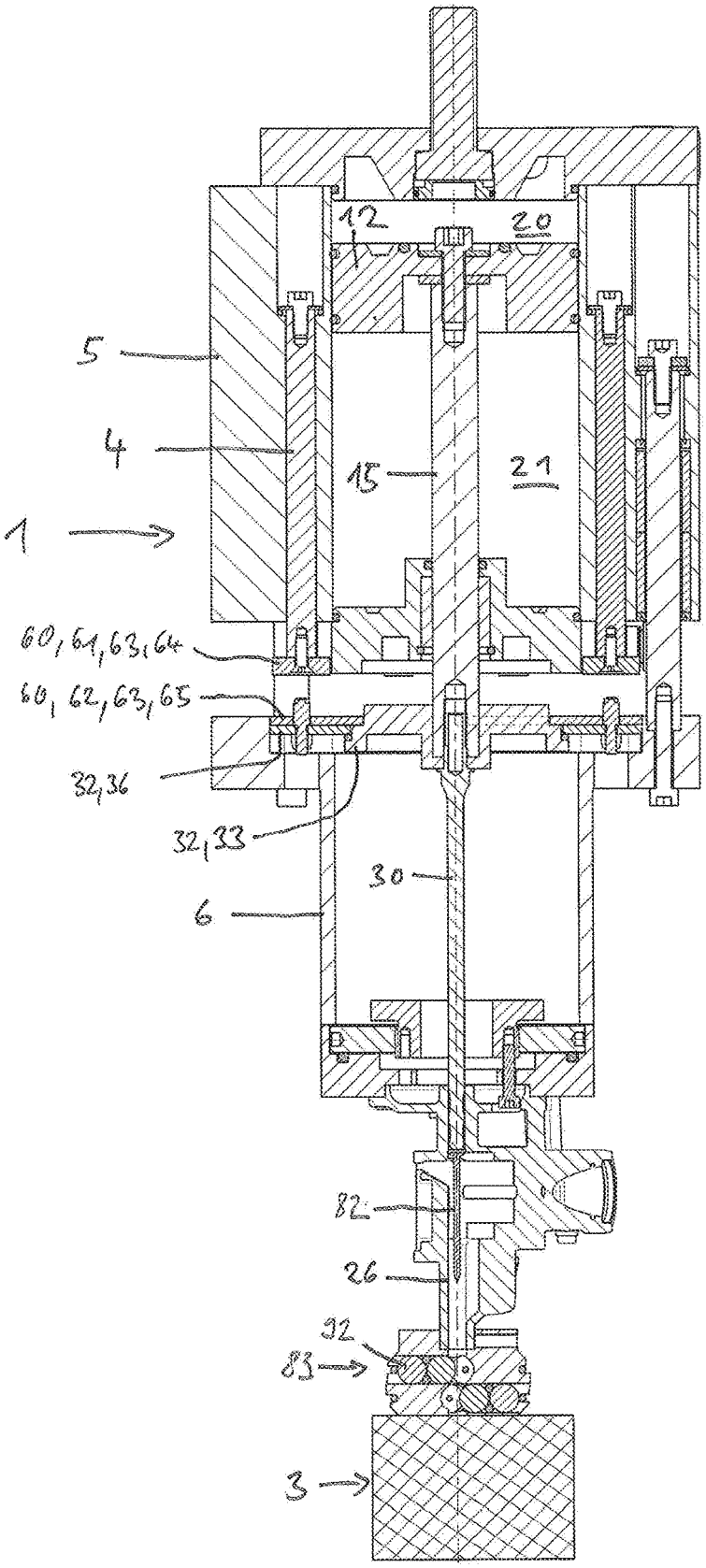
FIG. 8 shows a vertical section of the second driving tool with the outlet tool placed onto a workpiece.

The lowering onto the workpiece 3 takes place as in the case of the first driving tool 1, wherein, however, the nail centering 83 is placed onto the workpiece 3. This is shown in FIG. 8.

Figure 9:
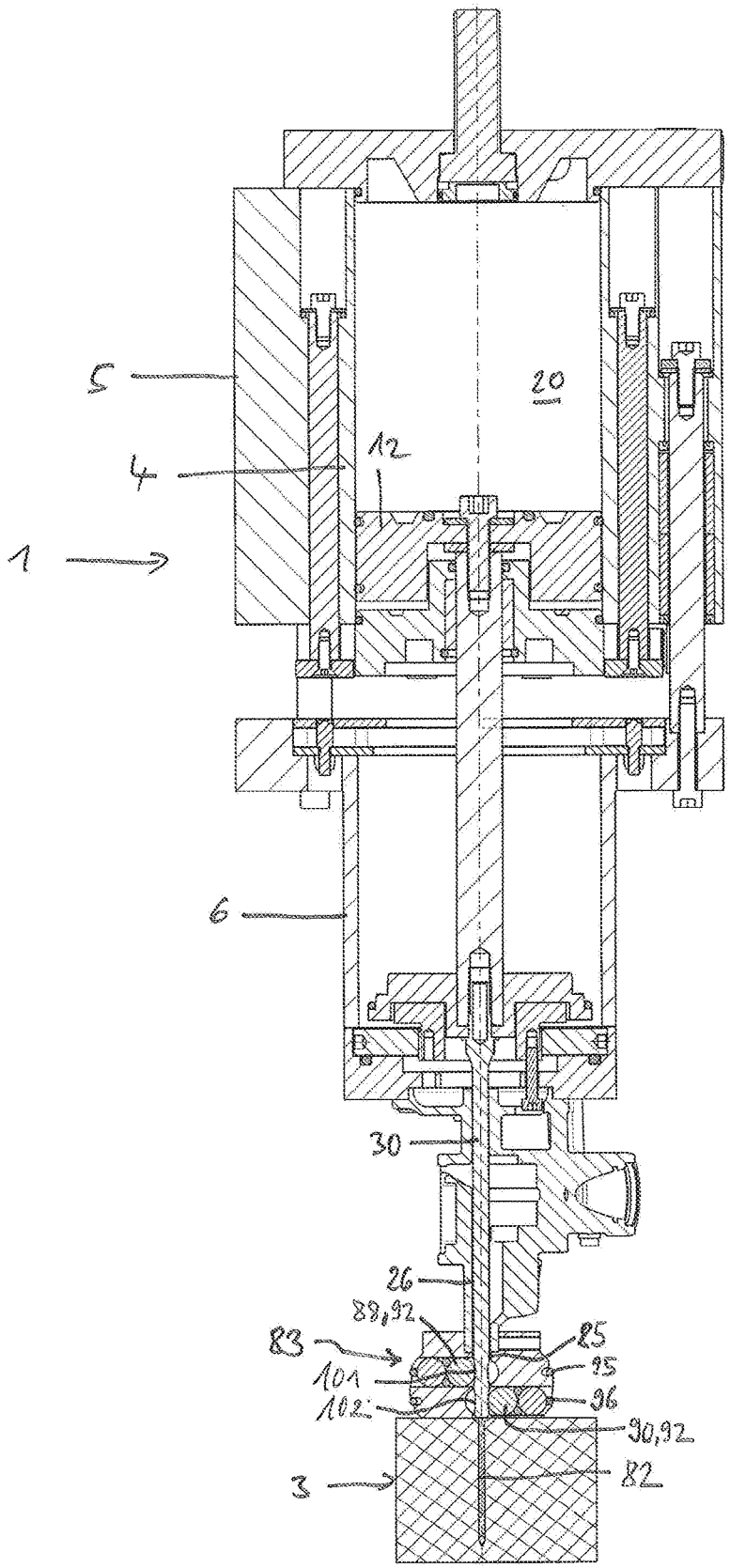
FIG. 9 shows a vertical section of the second driving tool with a nail just fully driven into a workpiece.

A nail 82 is driven in by a further proceeding of the piston 12 downward. The nail shaft is hereby centered by the circles 88, 89, 90, 91 of balls 92 so that it penetrates into the workpiece 3 in a straight line. FIG. 9 shows the driving tool with a nail 82 driven in to the given driving depth. The lower part of the driving tappet 30 also hereby engages with the centering channel 85 and with the centering opening 85.1. The balls 92 of the two inner circles 88, 90 engage with the two grooves 101, 102 and are held firmly therein by the snap rings 95, 96, 97, 98, 99, 100.

Figure 10:
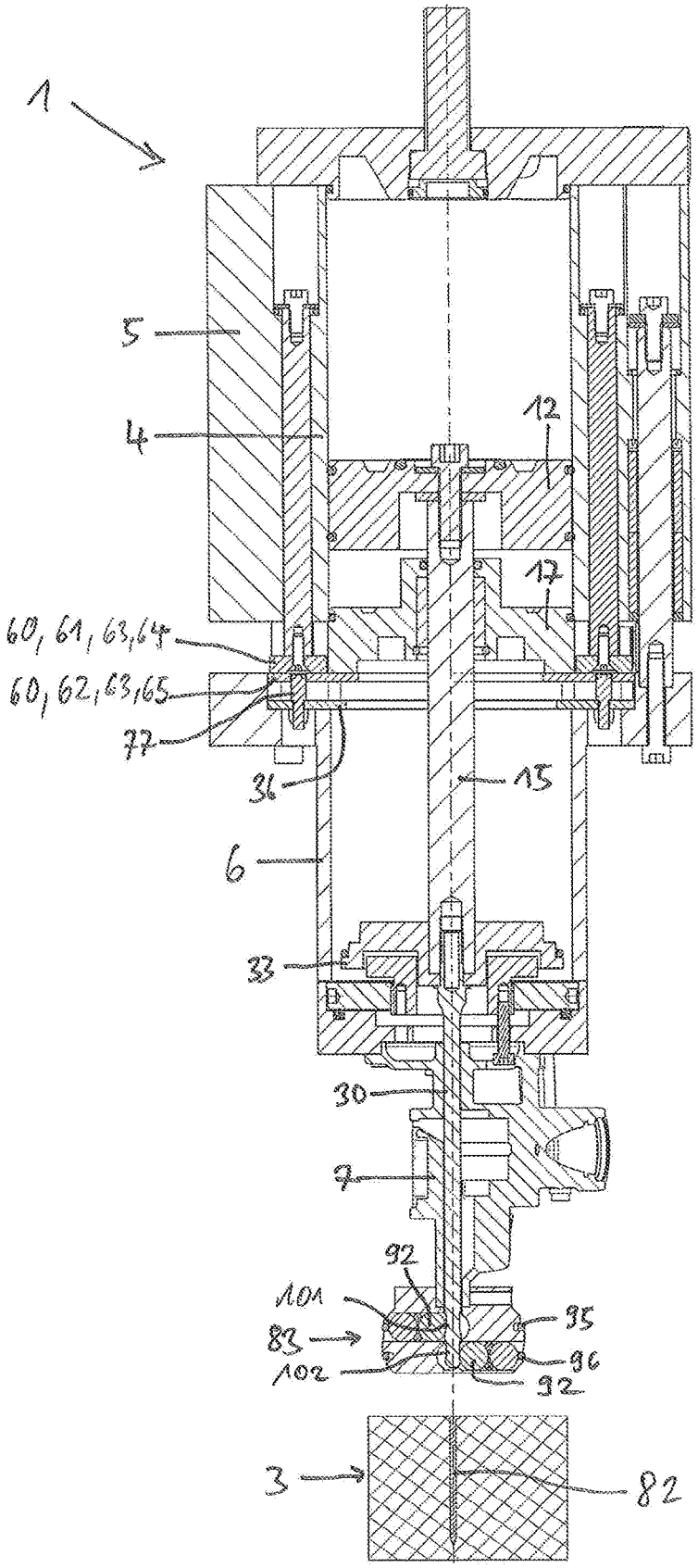
FIG. 10 shows the second driving tool with the outlet tool pulled away from the workpiece and magnetic coupling of the main cylinder and pressing cylinder.

According to FIG. 10, the following upward displacement of the piston 12 over the nail centering 83 results in the outlet tool 7 and the pressing cylinder 6 being lifted away upwards until the second magnetic coupling 63 couples.

Figure 11:
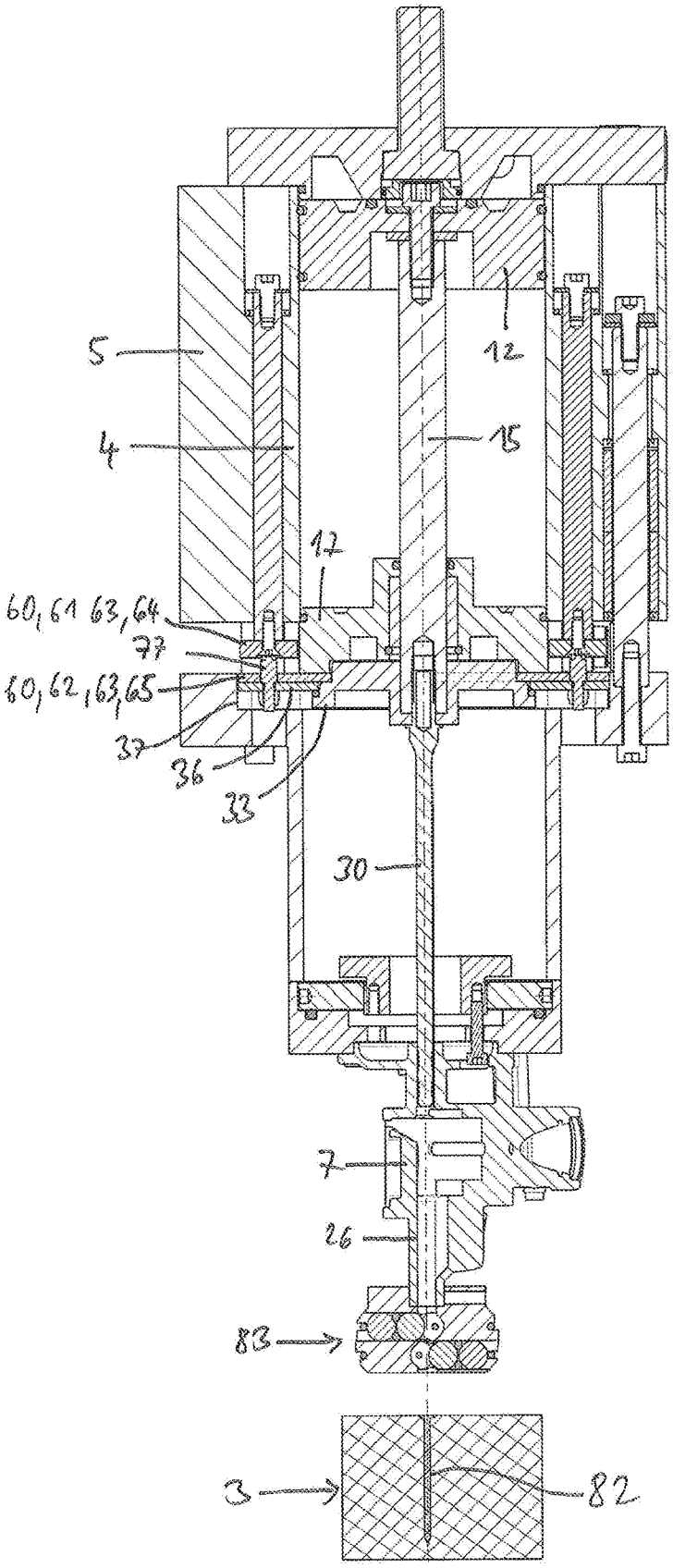
FIG. 11 shows a vertical section of the second driving tool with mechanical coupling and released magnetic coupling of the main cylinder and pressing cylinder.

The pressing cylinder 6 is hindered from a further upward displacement by the abutment of the sixth holding element 62 against the first floor plate 17 and the driving tappet 30 is pulled out of the nail centering 83. When the first holding element 33 hits the second holding element 36, the pins 77 release the second magnetic coupling 63. The pressing cylinder 6 is held firmly by the abutment of the first holding element 33 against the second holding element 36 and the second holding element 36 against the sixth holding element 62. This is shown in FIG. 11.

After feeding a further nail 82 from the magazine 8 into the driving channel 26, the driving tool 1 is ready for another driving process. This is shown in FIG. 7.

The third driving tool 1 from FIGS. 13 to 17 has, in contrast to the first driving tool, neither a first magnetic coupling nor a second magnetic coupling, nor a retracting device. Furthermore, the second holding element 36 is not held axially displaceably on the pressing cylinder 6, but rather is fixed in an inner step 103 on the upper edge of same.

Another difference consists in that the piston 12 has a hollow cylindrical outer piston rod 15 on the underside, on the lower edge of which the first holding element 33 protrudes circumferentially radially to the outside (piston excess). Furthermore, an inner piston rod 15.2 protrudes downwards centrally from the piston 12, the piston rod 15.2 being connected to the driving tappet 30. In the ring space between the inner piston rod 15.2 and the outer piston rod 15.1 as well as in the pressing cylinder 6, a compression spring 104 is arranged that is designed as a helical spring. The upper end of the compression spring 104 is supported on the underside of the piston 12 and the lower end is supported on the upper side of the first stop element 40.

The outer piston rod 15.1 passes through the first through hole 18 of the sealing element 17 in a sealing manner. There, the sealing element 17 has the fourth O-ring.

According to FIG. 13, in the initial situation in which the piston 12 is located in the upper piston position, the first holding element 33 abuts the second holding element 36 and firmly holds the pressing cylinder 6 on the underside of the sealing element 17. The compression spring 104 is pretensioned. The outlet tool 7 is hereby located in a spacing above the workpiece 3. The piston is held in the upper piston position by compressed air fed into the second air chamber 21.

According to FIG. 14, the piston 12 is displaced downwards in that compressed air is directed into the first air chamber 20 and the second air chamber 21 is ventilated. Hereby, the driving tappet 30 and the pressing cylinder 6 are synchronously displaced downwards. Due to the effect of the compression spring 104 and the intrinsic weight of the pressing cylinder 6, the second holding element 36 is held in abutment against the first holding element 33. The outlet tool 7 finally sits on the workpiece 3.

According to FIG. 15, in the case of the further downward displacement of the piston 12, the first holding element 33 comes free from the second holding element 36 and the outer piston rod 15.1 telescopes into the pressing cylinder 6. The driving tappet 30 is hereby moved downwards in the driving channel 26 and drives the nail 82 into the workpiece 3. The driving depth is determined by the set location of the second stop element 40 that the lower end of the outer piston rod 15.1 hits as the first stop element 39.

After that, the piston 12 is displaced upwards, wherein first the outlet tool 7 remains in abutment against the workpiece 3 and the driving tappet 30 is pulled out of the outlet tool 7 until the first holding element 33 hits the second holding element 36. This is shown in FIG. 16.

After that, the first holding element 33 takes the second holding element 36 and therefore the pressing cylinder 6 with it so that the outlet tool 7 is lifted away from the workpiece 3. Finally, the pressing cylinder 6 abuts the underside of the sealing element 17. This is shown in FIG. 17. After feeding a further nail 82 from the magazine 8 into the driving channel 26, the driving tool 1 is ready for another driving process.

The invention claimed is:

1. A driving tool for driving fastening means into workpieces comprising a main cylinder (4) with a piston (12) displaceable therein and a sealing element (17) on the lower end with a first through hole (18) through which a piston rod (15) connected to the piston (12) passes in a sealing manner, wherein a first air chamber (20) connected to a first air inlet for filling with air for the purpose of displacing the piston (12) downwards is present in the main cylinder (4) above the piston (12), and a second air chamber (21) connected to a second air inlet for filling with air for the purpose of displacing the piston (12) upwards is present below the piston (12), a pressing cylinder (6) that carries on the lower end an outlet tool (7) with a driving channel (26) into which a lower section of a driving tappet (30) connected to the piston rod (15) projects through an upper opening (27) and that has a lower opening (28) at the bottom for discharging fastening means (79), a magazine (8) for fastening means (82) that is attached to a side opening (29) of the driving channel (26) in order to supply fastening means (82) to the driving channel (26), a first holding device (32) that has a first holding element (33) connected to the piston rod (15) and a second holding element (36) connected to the pressing cylinder (6) that are designed so that the pressing cylinder (6) can be displaced into an upper pressing cylinder position by displacing the piston (12) into an upper piston position and the outlet tool (7) can be placed onto a workpiece (3) by displacing the piston (12) downwards from the upper piston position, a first stop device (38) that has a first stop element (39) connected to the piston rod (15) and a second stop element (40) connected to the pressing cylinder (6) that are designed to limit the downward displacement of the driving tappet (30) in order to drive a fastening element (82) out of the driving channel (26) and into a workpiece (3) to a determined penetration depth by means of the driving tappet (30).

2. The driving tool according to claim 1, in which the first holding device (32) comprises a first projection (33) protruding from the piston rod (15) radially to the outside and a second projection (36) protruding from the pressing cylinder (6) radially to the inside, wherein the first projection (33) is arranged below the second projection (36) so that in the upper piston position the first projection (33) abuts the underside of the second projection (36) and can be displaced downwards away from the second projection (36) when the outlet tool (7) sits on the workpiece (3).

3. The driving tool according to claim 2, in which the first projection (33) is arranged at the bottom on a hollow cylindrical outer piston rod (15) that passes through the through hole (18) in a sealing manner, the lower edge of the outer piston rod (15.1) is the first stop element (52), the driving tappet (30) is connected to an inner piston rod (15.2) arranged concentrically in the outer piston rod (15.1), and a compression spring (104) is arranged in the ring space between the outer piston rod (15.1) and the inner piston rod (15.2) as well as in the pressing cylinder (6) and is supported with the one end on the underside of the main piston (12) and with the other end on the upper side of the second stop element (40).

4. The driving tool according to claim 1, in which a second holding device (51) is present that has a third holding element (52) connected to the piston rod (15) and a fourth holding element (53) connected to the pressing cylinder (6) that are designed so that they firmly hold the piston rod (15) on the pressing cylinder (6) when the first stop element (39) abuts the second stop element (40) so that when the piston (12) is displaced upwards the pressing cylinder (6) can be displaced upwards with it, in which a third holding device (60) is present that has a fifth holding element (61) on the main cylinder (4) and a sixth holding element (62) on the pressing cylinder (6) that are designed so that they can be connected to each other when the pressing cylinder (6) is displaced upwards, whereby the pressing cylinder (6) is held in the reached position and the connection between the third and fourth holding elements (52, 53) of the second holding device (51) is eliminated when the piston (12) is further displaced upwards, and in which a retracting device (76) is present that is designed so that it releases the connection between the fifth and the sixth holding elements (61, 62) when the first holding element (33) hits the second holding element (36).

5. The driving tool according to claim 4, in which the second holding device (51) is a first magnetic coupling (54), wherein a first magnetic coupling element (55) is connected to the piston rod (15) and a second magnetic coupling element (56) is connected to the pressing cylinder (6).

6. The driving tool according to claim 5, in which the first magnetic coupling element (55) is the first stop element (39) and the second magnetic coupling element (56) is the second stop element (40).

7. The driving tool according to claim 4, in which the third holding device (60) comprises a second magnetic coupling (63) that has a third magnetic coupling element (64) connected to the main cylinder (4) and a fourth magnetic coupling element (65) connected to the pressing cylinder (6), and wherein the third holding device (60) comprises a second stop device (73) that has a third stop element (74) on the main cylinder (4) and a fourth stop element (75) on the pressing cylinder (6) that are designed so that they abut each other and prevent a further upward displacement of the pressing cylinder (6).

8. The driving tool according to claim 7, in which the retracting device (73) comprises vertically aligned pins (77), the second holding element (36) can be displaced in the vertical direction until it abuts the sixth holding element (62), wherein the pins (77) can be displaced upwards with their upper ends over the sixth holding element (62) in order to push the fifth holding element (61) away from the sixth holding element (62), and the piston (12) is located in the upper piston position when the second holding element (36) abuts the sixth holding element (62).

9. The driving tool according to claim 7, in which the third magnetic coupling element (64) is held on a vertical guide device that is designed so that the third magnetic coupling element (64) can be displaced vertically upwards starting from a lower stop position, wherein the third magnetic coupling element (64) can be coupled with the fourth magnetic coupling element (65) in the lower stop position and can be pushed upwards away from the fourth magnetic coupling element (65) by means of the pins (77).

10. The driving tool according to claim 4, in which the second holding device has at least one groove (101, 102) in a lower section of the driving tappet (30) and at least one locking element (93) on the outlet tool (7) that locks into the groove (101, 102) when the first stop element (33) abuts the second stop element (36).

11. The driving tool according to claim 10, in which the outlet tool (7) has a nail centering (83) that has a centering opening (85.1) below the driving channel (26) that is limited by at least one guide element (92) movable in the radial direction that is pretensioned in the radial direction towards the centering channel (85) by at least one spring device (95, 96), wherein the guide element (92) is simultaneously the locking element of the third holding device.

12. The driving tool according to claim 11, in which the nail centering (83) comprises a centering housing (84) in which at least one circle (88 to 91) of balls (92) is arranged, between which the centering opening (85.1) is defined, wherein at least one elastic snap ring or other elastic ring acts as a spring device (95, 96) on the outside of the balls (92).

13. The driving tool according to claim 1, in which the second stop element (40) is held by a setting device (41) in the pressing cylinder (6), wherein the setting device (41) is designed to set the vertical location of the second stop element (40) in the pressing cylinder (6).

14. The driving tool according to claim 13, in which the second stop element (40) is a ring with an external thread (44) that is screwed into an internal thread (43) of an adjusting ring (42), wherein the adjusting ring (42) is guided between a first and a second bearing in the pressing cylinder (6) so that it can be rotated in the pressing cylinder (6) but cannot be displaced in the vertical direction, and a linear guide (50) is present which allows a displacement of the second stop element (40) in the vertical direction but hinders it from rotating about a vertical axis.

15. The driving tool according to claim 1, held on a woodworking bridge (2) or on another displacement device or on a stationary tool support.

* * * * *